United States Patent [19]

Hoar

[11] Patent Number: 5,044,516

[45] Date of Patent: Sep. 3, 1991

[54] AUTOMATED PILL DISPENSING DEVICE

[76] Inventor: Russel A. Hoar, 6151 Vernon St., Long Beach, Calif. 90815

[21] Appl. No.: 588,149

[22] Filed: Sep. 26, 1990

[51] Int. Cl.[5] ..... B65B 59/00

[52] U.S. Cl. ..... 221/2; 221/3; 221/4; 221/15; 221/82

[58] Field of Search ..... 221/2, 3, 4, 15, 82, 221/83, 86, 89, 91, 122, 258

[56] References Cited

U.S. PATENT DOCUMENTS

| | | | |
|---|---|---|---|
| 3,556,342 | 1/1971 | Guarr | 221/2 |
| 3,651,984 | 3/1972 | Redenbach | 221/3 |
| 4,572,403 | 2/1986 | Benaroya | 221/3 |
| 4,573,606 | 3/1986 | Lewis et al. | 221/3 X |
| 4,674,651 | 6/1987 | Scidmore et al. | 221/3 |
| 4,748,600 | 5/1988 | Urquhart | 221/2 X |
| 4,811,764 | 3/1989 | McLaughlin | 221/3 X |
| 4,838,453 | 6/1989 | Luckstead | 221/2 |
| 4,872,591 | 10/1989 | Konopka | 221/3 |

*Primary Examiner*—David H. Bollinger

*Attorney, Agent, or Firm*—I. Michael Bak-Boychuk

[57] ABSTRACT

A medication dispensing assembly which comprises a stationary annular plate in which a boss formed on a moveable plate is received. The boss is provided with a set of deformations on its periphery which are useful to close a switch. A drilling in the moveable plate, aligned at each depression, is then useful to receive an insert pin to fill the deformation. A microswitch riding on the periphery of the boss is then closed at each unfilled deformation to provide an audio and visual signal. The moveable plate is provided with a set of depressed sectors each in alignment with a corresponding deformation on the boss and each provided with a dispensing hole. A single dispensing port is formed in the stationary plate and when the sector is advanced for dispensing to this port the visual and audio signals are set off.

5 Claims, 2 Drawing Sheets

AUTOMATED PILL DISPENSING DEVICE

BACKGROUND OF THE INVENTION

1. Field of the Invention

The present invention relates to pill dispensing mechanisms and, more particularly, to automated pill dispensers conformed for selective dispensing of pills in accordance with various administration schedules.

2. Description of the Prior Art

The administration of medicines is often prescribed in accordance with a particular schedule. The severity of the physical ailment, the tolerance of the patient, and the dosage all combine into a particular dispensing regimen which, for proper effectiveness, requires close adherence.

Nonetheless, this scheduling regimen is most often left to the personal attention of the patient. Since inattention, optimism, and forgetfulness are well known human attributes and for these reasons prescription schedules are often deferred to oblivion. Thus, the patient often skips the necessary medication or, on occasion, over medicates by excessive dosage.

In the past, various mechanisms have been devised which, in one way or another dispense medication at a given schedule. Exemplary techings of such mechanisms are set out in U.S Pat. Nos. 4,573,606 to Lewis et al.; 4,838,453 to Luckstead; 4,872,591 to Konopka; 3,651,984 to Redenbach; 4,811,764 to McLaughlin; 3,556,342 to Guarr; and 4,748,600 to Urquhart. Each one of these, while suitable for the purposes intended, entails complex structures, often with fixed timing apertures, and thus are often too complex for the rigors of home use.

An automated dispensing mechanism conveniently conformed for selective timing and simple in its configuration is therefore desired and it is one such mechanism that is disclosed herein.

SUMMARY OF THE INVENTION

Accordingly, it is the general purpose and object of the present invention to provide a pill dispensing assembly conformed for selective time interval operation.

Other objects of the invention are to provide a medication dispensing assembly conformed for operation in selective multiples of predetermined increments of time.

Yet further objects of the invention are to provide an automated pill dispensing assembly which includes both a visual and an audible signal source rendered operative upon each expiration of selected intervals of time.

Briefly, these and other objects are accomplished within the present invention by providing an electrical motor geared to rotate a circular dispensing plate divided into arc segments, each one of the segments being loaded with a medication dose or pill. For example, the dispensing plate may include 56 separate arc segments and may be geared for one complete revolution in a single seven-day period.

In this division arrangement eight dispensing segments are advanced in a single one-day period, thus allowing for a dispensing regimen of up to eight medication increments in a 24-hour day. Formed on a lower surface of the dispensing plate is a circular axially extending boss which includes a plurality of tangential depressions corresponding with each of the dispensing segments. A roller cam at the end of a switching lever extending from a micro switch rides on the periphery of the boss and effects switch closure upon each depression.

Formed in the surface of the dispensing plate are a plurality of drillings or openings each aligned with a corresponding depression in the surface of the boss. A set of color coded inserts is then useful for receipt in selected ones of the drillings to selectively fill the corresponding depression. The user can thus manually program the timing sequence of the dispensing cycle by controlling when the microswitch is closed.

A light source and a buzzer are connected in circuit with the microswitch and are rendered operative each time the roller cam falls into a depression. At the same time the corresponding sector lines up with a dropping chute formed in a supporting base plate, allowing the pill to drop for dispensing.

In this manner a simple and inexpensive mechanism is devised which is conveniently programmed for any one of many dispensing regimens that may be prescribed.

DESCRIPTION OF THE PREFERRED EMBODIMENT

Figure 1:
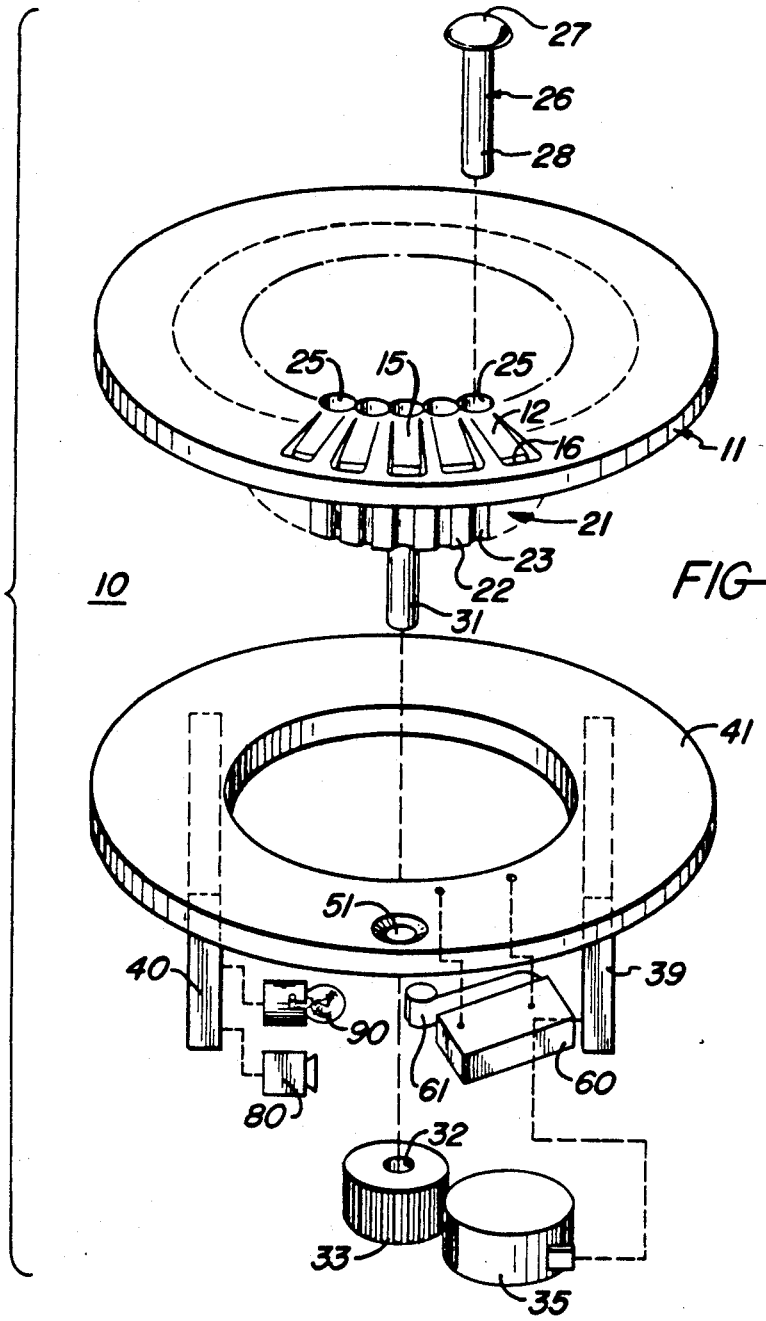
FIG. 1 is a perspective illustration separated by parts, of the inventive dispensing assembly.
Figure 2:
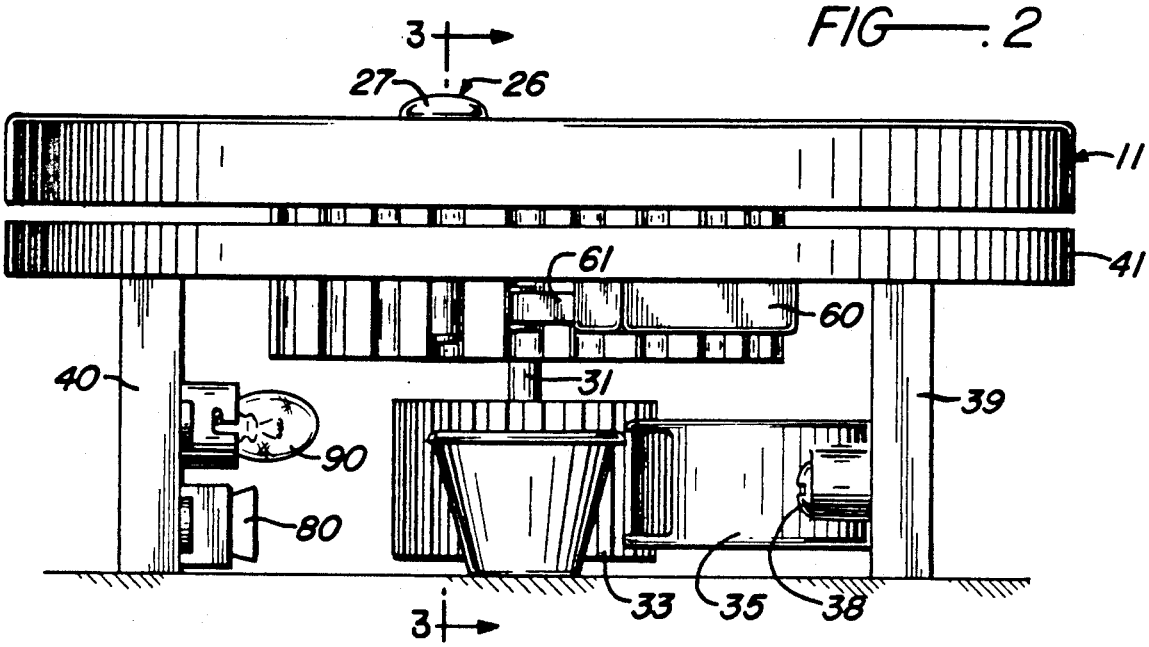
FIG. 2 is a front view of the inventive dispensing assembly in its operative arrangement.
Figure 3:
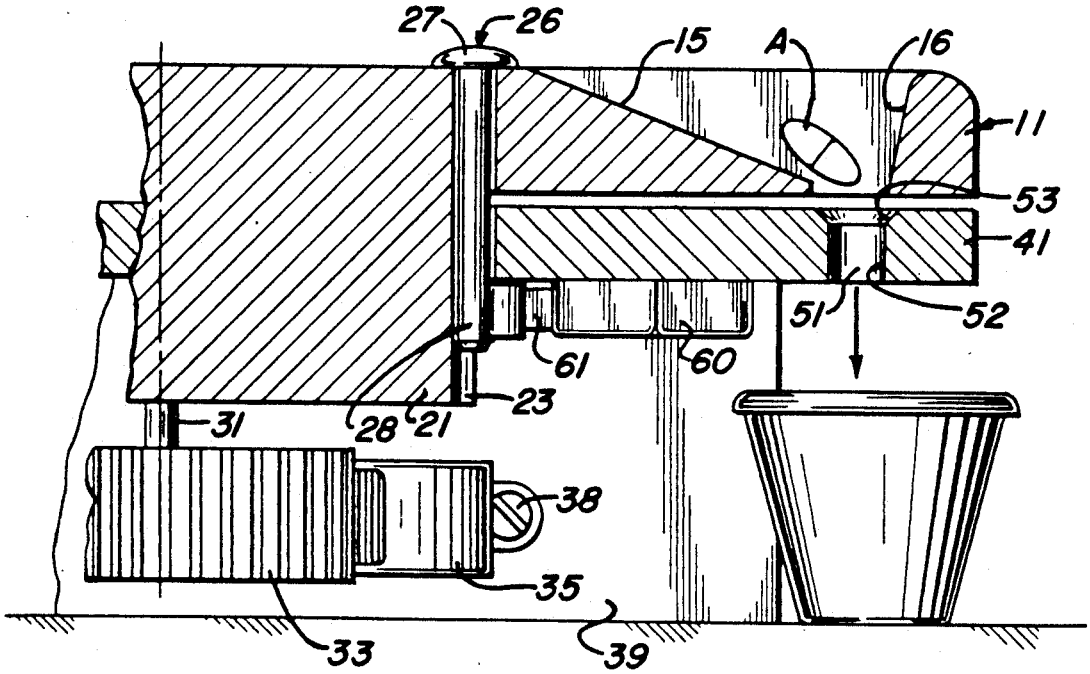
FIG. 3 is a sectional view detail taken along line 3—3 of FIG. 2.

As shown in FIGS. 1-3 the inventive dispensing assembly, generally designated by the numeral 10, comprises a circular dispensing tray or plate 11 provided with a plurality of depressions or sectors 12 on its upper surface, each in the form of an arc segment and each defined by sidewalls and a sloping bottom surface 15. Surface 15 extends downwardly from the interior end of section 12 and terminates at an opening 16 proximate the arc exterior. Preferably, opening 16 includes dimensions sufficient to pass a medication pill or ampule A.

At the lower surface plate 11 is provided with a concentric circular boss 21 coaxially extending therefrom the define a peripheral surface 22 around its exterior. Surface 22 includes a plurality of vertical depressions 23 each in alignment with a corresponding sector 12 and each subjacent a corresponding drilling 25.

It is these drillings 25 that selectively receive corresponding pins 26, each defined by a cap 27 and an axial shank 28. When inserted, cap 27 rests on the surface of plate 11 with the shank 28 extending to fill the corresponding depression 23. Thus, the user may select those depressions 23 in the cam surface 22 which are to be filled with pins 26. Each of the pin caps 27 may be distinctively colored for a visual index of those depressions that are filled.

An axle 31 extends from the center of boss 21 to pass into the interior of a keyed fitting 32 formed at the output of a gear reducer 33. Reducer 33 is meshed to the output of a clock drive motor 35 set, in conventional configuration, for a 24 hour rotation. Preferably, reducer 33 effects a 1:7 reduction, thus applying a seven day (one week) time interval for one complete revolution of axle 31.

The reducer-motor combination may be fixed by fasteners 38 to the inside surface of one support panel 39. Another support panel 40, with panel 39, then supports an annular plate 41 aligned below plate 11. In this alignment the openings 16 in each sector 12 are opposed by the adjacent surface of the annular plate 41 maintaining the distributed ampules A within each sector.

Plate 41 includes, at one azimuth, a dispensing port 51 generally devised by a drilling 52 chamfered at the upper edge by a chamfer 53.

A normally closed microswitch 60 is secured to the underside of the annular plate 41 to present the end of a spring loaded lever 61 against the lateral surface 22 of boss 21. To reduce contact forces lever 61 may include a roller 63 at its free end and will thus follow the contour of each depression 23.

Of course, those depressions that are filled with the inserted shanks 28 of the pins 26 will not allow for lever following in the filled depression. Thus, the closing of microswitch 60 will occur only at those depressions that are unfilled.

Figure 4:
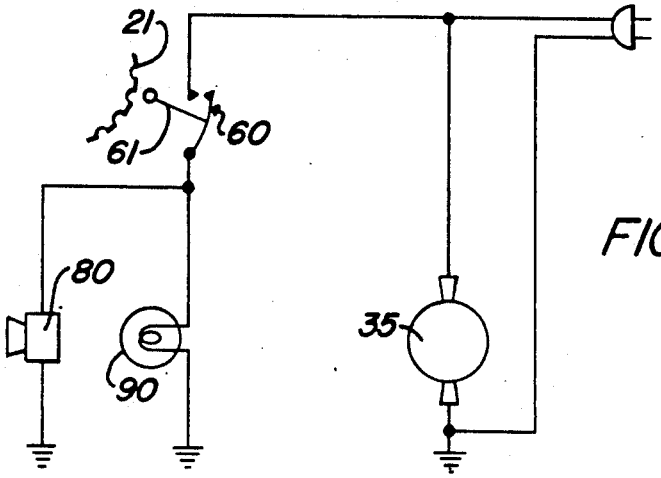
FIG. 4 is a circuit diagram useful with the invention herein.

As shown in FIG. 4 microswitch 60 may excite, in parallel, both a buzzer 80 and a light 90 placed adjacent the dispensing chute, to illuminate a dispensing cup 95 placed therebelow.

Obviously many modifications and changes may be made to the foregoing description without departing from the spirit of the invention. It is therefore intended that the scope of the invention be determined solely on the claims appended hereto.

What is claimed is:

1. A medication dispensing assembly, comprising:

a first, substantially circular, plate characterized by an upper surface and a lower surface;

a plurality of radial depressions formed in said upper surface of said first plate, each said depression being formed as an arc segment of said first plate and each said depression including a bottom surface sloped towards an opening extending to said lower surface proximate the periphery of said first plate;

a substantially cylindrical boss extending axially from said lower surface and including a plurality of spaced deformations in the periphery thereof, each said deformation corresponding to a predetermined depression;

a plurality of drillings extending through said first plate in corresponding alignment with said deformation;

a plurality of pins selectively insertable into said drillings and extending into the corresponding ones of said deformations;

a second, substantially annular, plate conformed to receive said boss in the annulus thereof and including a dispensing perforation at one selected azimuth;

a source of motive power conformed to advance in rotation said first plate relative said second plate;

switching means mounted on said second plate and operative by said deformations in said boss; and signaling means connected to said switching means.

2. Apparatus according to claim 1 wherein:

said switching means includes a microswitch provided with a lever aligned to engage the peripheral edge of said boss.

3. Apparatus according to claim 2 wherein:

said signaling means includes a light rendered operative by said microswitch.

4. Apparatus according to claim 1 wherein:

said dispensing perforation is aligned subjacent the rotary advancement path of said openings.

5. Apparatus according to claim 4 wherein:

said second plate includes support means for support thereof above ground; and said source of motive power is secured to said support means.

* * * * *